United States Patent [19]

Riewald et al.

[11] 4,053,011

[45] Oct. 11, 1977

[54] PROCESS FOR REINFORCING ALUMINUM ALLOY

[75] Inventors: Paul Gordon Riewald; William Henry Krueger; Ashok Kumar Dhingra, all of Wilmington, Del.

[73] Assignee: E. I. Du Pont de Nemours and Company, Wilmington, Del.

[21] Appl. No.: 724,249

[22] Filed: Sept. 17, 1976

Related U.S. Application Data

[60] Division of Ser. No. 615,356, Sept. 22, 1975, Pat. No. 4,012,204, which is a continuation-in-part of Ser. No. 522,881, Nov. 11, 1974, abandoned.

[51] Int. Cl.[2] ..... B22D 19/02

[52] U.S. Cl. ..... 164/97; 75/DIG. 1; 75/138; 428/558; 428/570; 428/545

[58] Field of Search ..... 29/191.2, 195 M; 75/138, DIG. 1; 164/97

[56] References Cited

U.S. PATENT DOCUMENTS

| | | | |
|---|---|---|---|
| 1,620,081 | 3/1927 | Czochralski et al. | 75/138 |
| 2,793,949 | 5/1957 | Imich | 75/135 |
| 3,668,748 | 6/1972 | Divecho et al. | 29/419 |
| 3,828,839 | 8/1974 | Dhingra | 164/97 |

FOREIGN PATENT DOCUMENTS

| | | | |
|---|---|---|---|
| 927,500 | 2/1971 | Germany | 75/138 |
| 787,665 | 12/1957 | United Kingdom | 75/138 |
| 870,261 | 6/1961 | United Kingdom | 75/138 |

OTHER PUBLICATIONS

"Development of Composite Structural Materials, for Space Applications", Sutton, ARS Journal, v32, No. 4 (1962), pp. 593–660.

*Primary Examiner*—Arthur J. Steiner

[57] ABSTRACT

A composite reinforced with polycrystalline alumina fibers in a matrix of an aluminum alloy containing 0.5–5.5% by weight of the matrix of lithium is prepared by infiltrating alumina fibers with a molten alloy containing aluminum and 1–8% by weight of lithium for a time sufficient to form a reaction sheath on the fibers of a thickness less than about 15% of the total fiber diameter.

11 Claims, 1 Drawing Figure

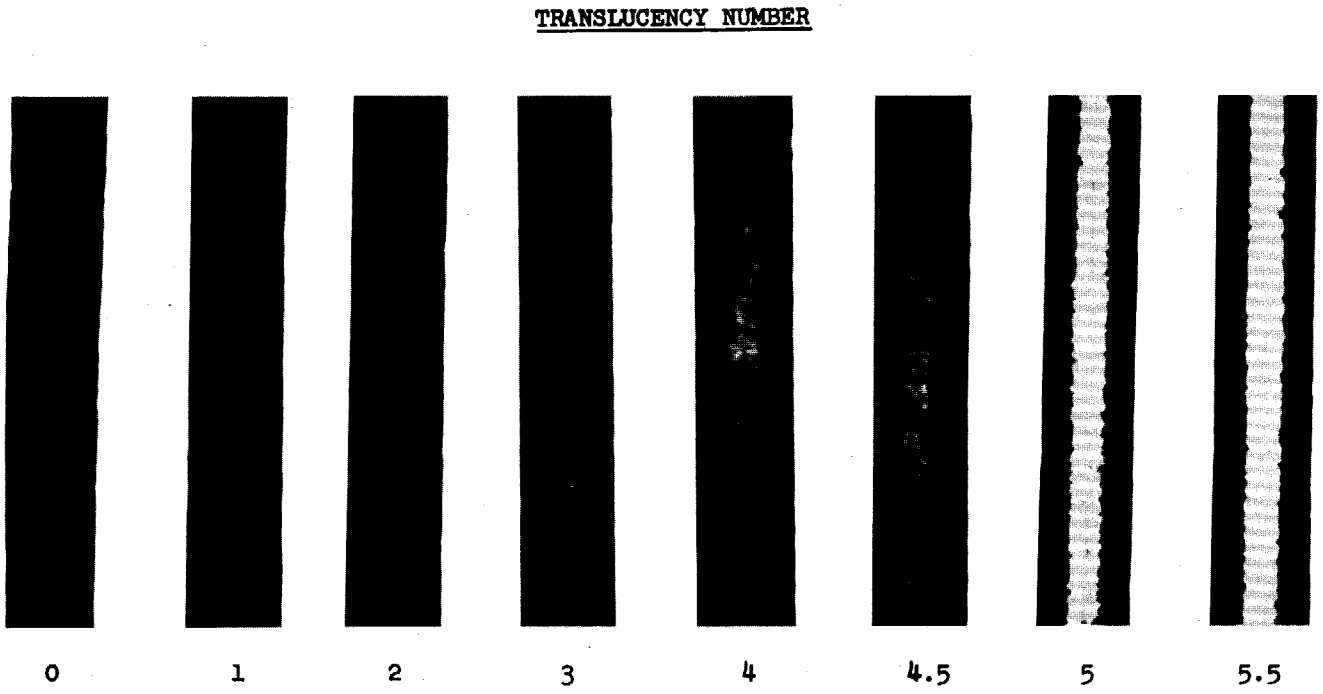
TRANSLUCENCY NUMBER
0
1
2
3
4
4.5
5
5.5

PROCESS FOR REINFORCING ALUMINUM ALLOY

CROSS REFERENCE TO RELATED APPLICATION

This is a division of application Ser. No. 615,356, filed Sept. 22, 1975, and now U.S. Pat. No. 4,012,204, which is in turn a continuation-in-part of application Ser. No. 522,881, filed Nov. 11, 1974, now abandoned.

BACKGROUND OF THE INVENTION

This invention relates generally to the reinforcement of metals with fibers and, more particularly, to the preparation of composites of alumina fibers and aluminum.

Polycrystalline $Al_2O_3$ fiber has long been considered ideal for reinforcing metals because of its high modulus and strength, chemical inertness and high temperature stability. Aluminum is ideally used in the aerospace, transportation and other industries because of its light weight, excellent corrosion resistance and low cost. It is the prime candidate for reinforcement with continuous polycrystalline $\alpha$-$Al_2O_3$ fibers prepared, for example, as described by Seufert in U.S. Pat. No. 3,808,015. The major problem limiting the utilization of $Al_2O_3$—Al composites has been the lack of a practical method to fabricate them due to the fact that aluminum does not adequately wet alumina.

Considerable effort has been expended in attempts to obtain wetting of the surface $Al_2O_3$ fibers with aluminum, for example, by coating the surface of $Al_2O_3$ fibers with metals like Ni, Ti, Cu and the like. However, these metal coating methods are slow, expensive, difficult to scale up and sometimes yield composites with brittle interfaces. Brittle interfaces tend to lower the mechanical properties such as flexural and shear strengths.

SUMMARY OF THE INVENTION

It has now been found that the difficulties noted above can be overcome with infiltrating polycrystalline alumina fibers with a molten aluminum alloy containing about 1–8% by weight of lithium to form a reinforced composite having a reaction sheath on the fibers of a thickness of less than about 15% of the total fiber diameter and then cooling the composite. In this manner, composites which are substantially free of brittle interfaces and which have good longitudinal and transverse mechanical properties have been prepared. Such composites contain from about 10–80 volume percent of alumina fibers, a matrix of an aluminum alloy containing from about 0.5 to about 5.5% by weight of the matrix of lithium and a reaction sheath on the fibers which has a thickness of less than 15% of the total fiber diameter.

FIGURE

The FIGURE is a photomicrograph of $Al_2O_3$ fibers which are about 22 microns in diameter.

DETAILED DESCRIPTION OF THE INVENTION

The composites of this invention can contain fiber volume fractions within the range of 10–80 volume percent, preferably about 15–70% volume percent. Below about 15 volume percent, there is little practical advantage in terms of strength or modulus. At greater than about 70 volume percent, the fibers tend to contact each other and each contact point is a stress area from which fractures can emanate. The composite can contain either continuous filaments or discontinuous fibers of polycrystalline alumina.

As used herein, "continuous filament" denotes a fiber having a length about as long as that of the composite as measured in the direction in which the fiber is aligned. Discontinuous fibers have a minimum length of about 0.10 mm, preferably at least 3 mm. When the composite contains substantially continuous filaments, fiber fractions of about 30–60 volume percent are preferred for best fiber distribution and packing in the composite. When the composite contains substantially randomly oriented discontinuous fibers, about 15–30 volume percent is the preferred fiber fraction.

The fibers in the composite can be aligned in any direction or directions in which maximum strength or modulus is desired. Such alignment may be parallel, perpendicular or at any other angle with respect to any axis in the composite. The fibers may also be randomly oriented in the composite structure.

Examples 1–4 show unidirectional fiber-reinforced composites; such composites have highest strength and modulus in the direction of fiber alignment. For some applications, more isotropic properties are desired and can be obtained by using parallel layers (plies) of unidirectionally oriented fibers and crossing the plies at different directions (e.g., 45°) to the adjacent ply. More isotropic properties can also be obtained by using a random orientation of the discontinuous fibers throughout the composite but such a fiber distribution limits the fiber loading to a maximum of about 35 percent of the composite.

The fibers employed herein are high modulus, high strength, polycrystalline alumina fibers. Preferred fibers contain at least 60% aluminum oxide ($Al_2O_3$) by weight. All other things being equal, the mechanical properties of a composite, such as maximum modulus and high temperature resistance, generally increase as the amount of $Al_2O_3$ in the fiber increases. Accordingly, fibers containing at least 80% of $Al_2O_3$, preferably at least 95% $Al_2O_3$ are most preferred. Generally, the most preferred fibers contain $Al_2O_3$ in the form of alpha alumina. The fibers can be prepared as described by Seufert in U.S. Pat. No. 3,808,015 and by D'Ambrosio in U.S. Pat. No. 3,853,688. The strength of some such alumina fibers as increased by a silica coating having a thickness of about 0.01 to 1 micron ($\mu$). Methods of providing fibers with such silica coatings are described by Tietz and Green in U.S. Pat. Nos. 3,837,891 and 3,849,181, respectively. Such silica coatings also promote wetting by aluminum-lithium alloys and permit the preparation of high quality composites using allows with a lower lithium content than would be required with uncoated fibers using the same time and temperature of infiltration.

In addition to being as strong as possible, it is also desirable that the fibers be as dense as possible since a higher degree of fiber strength is retained in the composite as the density of the fiber increases. When fibers are made by the general process described by Seufert, the density of the fibers is increased by conducting the final sintering (or firing) of uncoated fibers at a temperature slightly above the temperature at which the uncoated fiber achieves its maximum tensile strength. Since there is an interrelationship between the speed of the fiber through the flame, the type of equipment used, the denier and number of the fibers, and so on, the precise temperature to be used in any given case is necessarily determined by the overall balance among the factors which enter into the interrelationship. For example, the sintering of a 1700–1800 denier yarn of about 200 fibers at a speed of 60 feet per minute through a flame in a chimney at a temperature of about 20°–100° C. higher than that at which the fiber achieves its maximum tensile strength affords preferred fibers for use in the composites of this invention. While the fiber composition is the same, the higher fired material is more compact and dense and has a different microstructure as judged by scanning electron micrographs. As a result, the higher fired fiber can withstand longer exposure to the aluminum-lithium alloy with substantial retention of the original fiber strength than the same fiber fired at the lower temperature. Accordingly, while the strength of the fiber going into the composite may be lower than the maximum tensile strength of the fiber as a result of the higher firing temperature, the strength of the fiber in the composite could be considerably higher than the strength of the maximum tensile fiber since the more dense fiber is not subject to the same degree of attack by the alloy. The preferred fibers may also be coated with silica.

In ascertaining increases in density which result from the above higher firing treatment, the conventionally employed density measurements are insufficiently sensitive to distinguish the higher from the lower fired structure. A more sensitive test is required. It has been found that as the density of the fiber increases as a result of the higher firing temperature, the microstructure changes and the fiber tends to transmit more light. Utilizing this phenomenon, a dense fiber which results from the higher firing treatment can be distinguished from a less dense fiber of similar composition and diameter by its translucency number. The translucency number is an average of determinations on 30 random samples obtained by viewing a length of fiber in air at 600–1200X, preferably 1200X, using transmitted light. The amount of light transmitted by a fiber is rated in terms of translucency number on a scale of from zero to six, and the accompanying Figure can be used as a standard in rating the fibers. A translucency number of six is given to the most translucent fiber of a given composition and diameter. Such a fiber displays a bright band in the center and along the entire length of the fiber. The bright band has a width of about ⅓ the fiber diameter and is contained between two opaque (black) bands, each extending from a fiber edge to the outer edge of the bright center band. As the Figure shows, when the intensity of the light transmitted by the center band decreases, the translucency number lowers. At a translucency number of zero the fiber appears opaque and no center band can be distinguished. The Figure illustrates that the relationship between the opacity of the fiber and its translucency number is approximately linear. Fibers having a translucency number of 4–5.5 are preferred for this invention. The translucency number can also be determined on fibers containing a coating of silica in the same manner.

Preferred fibers also have a diameter of between about 15 and 30 $\mu$, a tensile strength of at least 100,000 psi, preferably greater than 200,000 psi, and a Young's modulus of at least 20 million psi. In addition to $Al_2O_3$, the fibers can contain other refractory oxides and/or refractory oxide systems such as $SiO_2$, MgO, $ThO_2$, $ZrO_2$—CaO, $ZrO_2$—MgO, $ZrO_2$-$SiO_2$, $Ce_2O_3$, $Fe_2O_3$, NiO, CoO, $Cr_2O_3$, $HfO_2$, $TiO_2$ and the like. These fibers should have a melting point of at least 1000° C. Preferably, the fibers will be employed in the form of a tow of continuous alumina filaments.

The composite matrix will contain at least 60% by weight of aluminum, preferably at least 90%, and 0.5–5.5% by weight of lithium. The concentration of lithium in the matrix is generally lower than its concentration in the starting alloy since some of the lithium is consumed in forming the reaction sheath around the fibers. Additional losses may occur during fabrication by reaction with the crucible, sublimation and/or oxidation.

A third component comprising one or more metals capable of being alloyed with aluminum may also be present in the matrix at a concentration of up to about 10% by weight of the matrix. Since only a limited number of metals can be alloyed with aluminum to produce alloys of practical significance, the constituents of the aluminum alloys useful as a matrix in the composites of this invention are similarly limited. Suitable primary metals for alloying with aluminum include copper, iron, magnesium, manganese, nickel, silicon, tin, zinc, titanium and the like and mixtures thereof and trace amounts of 1% by weight of the matrix or less of secondary metals such as beryllium, bismuth, boron, cadmium, calcium, chromium, cobalt, gallium, lead, sodium, strontium, vanadium, zirconium and the like and mixtures thereof.

It will be appreciated that for most applications the matrix in the composite should be ductile. The ductility of the matrix is evidenced by a strain-to-failure of greater than 0.2% for the composite. When continuous alumina filaments are used, the upper limit of strain measured in the direction of filament alignment can be as high a the strain-to-failure of the alumina filaments. When discontinous alumina fibers (stable fibers) are used, the strain-to-failure of the composite is limited by the ductility of the matrix, amount of loading, orientation of the fibers and other such considerations. All of the matrices of the examples of the invention are ductile by this definition.

The lithium-aluminum alloys used in this invention chemically wet the fibers, thus providing excellent fiber-matrix bonding and composites which have good high temperature performance properties. The preferred composites of this invention have longitudinal short beam shear strengths of at least 7000 psi (measured at room temperature 25° C.). The short beam shear value is a measure of overall composite quality including the degree of bonding between the fibers and the matrix, the strength of the matrix and the in situ fiber strength. Composites having a room temperature short beam shear of less than 7000 psi do not possess best overall composite qualities.

The composites of this invention also have a porosity of less than about 10%, preferably 5% or less, and most preferably less than 2%. At a porosity of 10% or more, the composite has lower overall mechanical properties. Such composites are not satisfactory for structural applications, for example, since the pores in a composite act as points of stress concentration. At porosities of 10% or more, the stress concentration phenomenon can result in poor fatigue behavior. A porosity of 25% or more is considered evidence that the alloy has not wet the fibers.

The preferred composites of this invention also have a longitudinal modulus at room temperature of at least $15 \times 10^6$ psi and a modulus of about $25 \times 10^6$ and up to about $45 \times 10^6$ psi is most preferred. The more preferred composites have a flexural strength at room temperature equal to or greater than the product of 1900 psi and the volume of fibers in % between the range of 30–60 volume percent. Thus, a composite containing 50 volume percent fibers would have a flexural strength of at least 95,000 psi.

METHOD OF PREPARATION

The composite matrix is prepared from an aluminum alloy containing at least about 60%, preferably 90%, by weight of the alloy of aluminum and about 1–8%, preferably 2–5%, by weight of lithium. Composites having the best mechanical properties are prepared at the preferred concentrations of lithium and aluminum in the alloy melt and the matrix.

The composite structure is prepared by infiltrating the molten aluminum alloy into $Al_2O_3$ fibers contained in molds. Details of a general procedure for infiltration have been described by Dhingra in U.S. Pat. No. 3,828,839.

In this case, excellent composites can be made by infiltrating alumina fibers with an aluminum alloy melt containing a small amount of lithium under the proper conditions of temperature and time of heating. The fiber undergoes a reaction with the lithium in the alloy melt, and it is believed that this reaction is responsible for the wetting of the fibers by the molten metal and for good fiber-matrix bonding. The reaction forms a sheath around the fiber. At the minimum useful extent of reaction, the sheath may not be visible in cross sections. However, whenever reaction takes place, no matter how slight, the fiber surface becomes black or gray in contrast to its original white color. The presence of $LiAlO_2$ has been detected by X-ray analysis on fibers recovered from composites. Therefore, although the sheath may not be visible in cross sections, the fiber can be leached out of the composite by dissolving away the matrix, for example, in 20% aqueous hydrochloric acid and the fact of reaction determined from the color change. As the amount of reaction which has taken place increases, the sheath on the fiber becomes progressively larger and visible while the (apparently) unreacted core becomes smaller. As the sheath grows to about 20% of the fiber diameter, cracks or wedges frequently form. In extreme cases of reaction, the fiber core may be broken into several portions.

In order to retain a useful strength in the fibers, the reaction sheath in the composite should have a thickness of less than about 15% of the total diameter of the reacted fiber (including sheath). If the total diameter of the fiber including the reaction sheath is designated as ($d_1$), then the thickness of the reaction sheath ($t$) is one half of the difference between $d_1$ and the diameter of the unreacted fiber core ($d_2$), and the percent reaction sheath is $t/d_1$ (100). Accordingly, reaction conditions should be controlled so that a reaction sheath of 15% or more is not obtained. Since the amount of reaction that takes place increases with increasing temperature, increasing reaction time and increasing concentration of lithium in the melt, the interrelationship among these factors must be carefully controlled. For example, since lithium is a very reactive metal, as the concentration of lithium in the alloy increases, the alloy melt becomes more highly reactive with the $Al_2O_3$ fibers. It then becomes necessary to carry out the infiltration of the fibers with the alloy melts containing higher lithium concentrations at a lower temperature or within a shorter time, or both, than would be used with melts containing a lower concentration of lithium.

Generally, a composite having a reaction sheath of a thickness less than 15% of the total diameter of the fiber can be prepared at temperatures in the range of 25°–100° C. above the melting point of an aluminum alloy containing about 1–8%, preferably 2–5%, by weight of lithium with a reaction time of less than about 15 minutes. Satisfactory composites can be prepared at shorter reaction times and at a lower temperature when the alloy contains more than about 5% lithium. On the other hand, similar composites can be obtained at temperatures as high as 200° C. above the melting point of an alloy containing 2–3% by weight of lithium with a short reaction time. Thus, the reaction time, temperature and the lithium concentration in the aluminum alloy melt can be adjusted with respect to one another as required to achieve a reaction sheath on the fibers in the composite having a thickness of less than 15% of the diameter of the entire cross section of the fiber.

The mechanics of composite preparation in which the above conditions are to be observed may differ depending on the size of the composite to be produced. Small composites (Example 1 herein) have been prepared by inserting the fibers by hand into small unitary molds while larger composites (Example 3 herein) have been prepared by inserting a preform of the fibers in an organic, polymeric matrix into the mold which is then heated to remove the organic polymer, cooled and vibrated. For infiltration, the mold containing the fibers or a tube leading to the mold is inserted into a crucible containing the molten alloy. Stainless steel molds and silicon carbide crucibles have been found satisfactory. The molten metal may be from about 25°–200° C. above its melting point.

Small molds, as described in Example 1 herein, may be inserted directly into the melt and allowed to reach thermal equilibrium while the preferred procedure for larger molds is to preheat the mold containing the fibers before infiltrating.

The longitudinal axis of a mold can vary from near horizontal to vertical during infiltration depending upon the length of the mold. The use of horizontal or near horizontal attitude affords better control of the temperature of the mold and reduces any tendency to distortion and buckling in addition to providing a lower pressure head of the molten metal.

Infiltration of the molten metal into the mold containing the fibers is accomplished by creating a pressure differential either by applying a vacuum to the mold or a positive pressure to the metal or a combination of both. The pressure differential should be sufficient to overcome the resistance to flow caused by the mold and fibers and the pressure due to the head of the molten metal. Excessive pressures can cause channeling in the mold. For fabricating the alumina-aluminum composites, a pressure differential of about 2 to 14 pounds/square inch (psi) has been satisfactory.

After the mold containing the fibers is thoroughly infiltrated, it is removed from the molten metal and allowed to cool to room temperature. The mold can be left on as a cladding or it can be removed. Cladded composites are preferred for subsequent rolling, swaging, drawing, hydrostatic extruding or hot isostatic pressure operations.

The products of this invention are useful as structural members in applications that require light-weight and high stiffness and strength, especially in aircraft and missiles. These products are also useful for structural applications at elevated temperatures such as in aircraft engines and turbines.

TEST PROCEDURES AND STANDARDS

Metallographic Examination

To assess the thoroughness of infiltration of metal matrix between the alumina fibers and the extent of reaction between the fibers and the alloy matrix, transverse sections of the composite specimens are examined metallographically. Specimens are mounted in a suitable resin such as phenolformaldehyde, epoxy or polyester and are polished with a series of polishing grits beginning with approximately 100 grit and going down to 0.3 micron ($\mu$) diamond paste.

Fiber/Matrix Reaction

Metallographic examination of the polished cross sections at a magnification of 600× can be used to determine a reaction sheath having a different appearance from the apparently unreacted core, and the thickness of this reaction sheath is reported in the Examples in microns ($\mu$). Those samples in which the fibers appear to be unreacted are considered to have undergone a minimal amount of reaction with the matrix and the fiber reaction sheath is reported in the Examples as "$<0.5\ \mu$". That reaction has taken place can be ascertained by extracting the fibers from the composites and noting their black or gray color.

Composite Quality

The polished cross-sections described above are examined at about 60× magnification and the porosity of the cross-section is obtained by estimating the areas of voids compared to the total area in the cross-section. Porosity is caused by faulty techniques of composite preparation and/or an insufficient wetting of the fibers by the metal. Hence, the degree (%) of porosity is a useful quality control index.

The porosity can be conveniently and precisely determined by vacuum depositing aluminum on the above polished corss-sections and then analyzing each cross-section with a reflected light microscope and a Quantimet 720 instrument (an image analyzing computer made by Imanco, New York, N.Y. as reported in an article by M. Cole in *Americal Laboratory,* June 1971). The cross-section is analyzed by viewing the number of separate and distinct fields of view that approximate the entire cross-section. The system is operated under conditions that detect voids as small as 2 $\mu$ in diameter. The voids are "seen" as black against the relatively high reflectance of the aluminum-coated fibers and solid matrix.

Fiber Properties

Single fibers are broken on an Instron tensile testing machine Model TM at a crosshead speed of 0.02 inch per minute using gauge lengths of 0.25 and 10 inches. Tensile strength is obtained from the 0.25 inch gauge results. The modulus (Young's) is obtained by plotting the reciprocal of the modulus (1/M) obtained at the 2 gauge lengths against the reciprocal of the gauge length (1/G) and using the value of 1/M at 1/G (extrapolated) of zero to calculate the reported modulus. This method is followed to correct for any fiber slippage in the test. Similar results can be obtained with shorter fibers by using gauge lengths of, for example, 0.25 and 1 inch.

Composite Mechanical Properties

In addition to metallographic examination of the composites as described above, mechanical properties are another measure of the quality of the composites. The mechanical properties such as flexural strength and modulus are indicative of mechanical performance of the composites, particularly as structural materials. A measure of the strength, stiffness, and strain-to-failure of the composites is obtained from flexural tests.

Flexural strength, modulus and strain-to-failure are determined using the method of ASTM D-790-71 except that round rods are used instead of rectangular bars.

Short beam shear (S.B.S.) strength values are determined on composites containing randomly oriented as well as aligned fibers using the method of ASTM D-2344-67. Normally, the portions of the specimen remaining after a flexural strength determination are used for this test.

Unless stated otherwise, all values in the examples are longitudinal, i.e., meansured on a bar or rod having the fibers aligned along its length, and are measured at room temperature.

Metal Analysis

The alloys and the composites themselves are analyzed for metals by dissolving the matrix from about a 0.25 gram sample of the composite in 20 milliliters (ml) of a mixture of equal volumes of concentrated hydrochloric acid (35%) and water. The resulting solution is diluted to 100 ml with water and analyzed in an Atomic Absorption Spectrophotometer (Perkin-Elmer Model 503). The fibers in the composite do not appear to be afffected by the acid.

Characterizations obtained by the tests described above and other detailed information concerning the composites are set forth in the following illustrative examples in which all parts and percentages are by weight unless otherwise specified. All fibers in the examples are made generally by the procedure outlined in U.S. Pat. No. 3,808,015.

EXAMPLE 1

A lithium-aluminum alloy was made by (1) heating a silicon carbide crucible to 700° C. in a pot furnace, (2) adding sufficient flux (LiCl:LiF, 3:1 by weight) to form an 0.5 inch layer of molten salt, (3) adding 500 grams of commercially pure aluminum shot (99.5 Alcoa), melting and then adding additional flux to totally cover the aluminum, (4) adding small pieces (0.5 × 0.5 × inch) of a commercial Al—Li alloy with a nominal Li content of 10%, submerging the alloy pieces and (5) stirring with a stainless steel rod. Additional flux was added to minimize the loss of lithium. The addition of Al—Li alloy was repeated until 500 grams of the alloy had been added. Analysis of the melt showed 3.9% lithium; the resulting alloy had a melting point of about 637° C.

To make a four inch long composite, 4 inch lengths of yarn, each containing 95 continuous filaments (average diameter of 23.3 ± 4.3 $\mu$) of polycrystalline alumina (nominal tensile strength of 200,000 to 239,000 psi, tensile modulus of 50 × $10^6$) were used. The filaments contain about 0.2% MgO with the remainder $Al_2O_3$, predominantly (greater than 90%) in the alpha form. The filaments were coated with about 0.02–0.2 $\mu$ thick layer of silica. The filaments were packed tightly into one end of a 12-inch length of a stainless steel tube (0.25 inch O.D. × 0.035 inch wall) to obtain a loading of about 60 volume percent. The filaments were separated and distributed uniformly across the inside diameter of the tube by holding the tube in a vertical position against a vertical rod-type vibrator (Type EI made by A. G. FurChemie — Apparatebau, Zuruck). The upper end of the tube was connected by a Y-connection and flexible vacuum hose to a U-tube mercury manometer and to needle valve (closed) in series with a vacuum source. The lower portion of the tube containing the aligned filaments was placed below the surface of the flux and the melt of the allow at 680–700° C. and held for about 1 minute for the tube and fibers to reach the melt temperature. Then, the valve was slowly opened so that the pressure in the mold changed from atmospheric to 60–70 cm of mercury over a period of 2–4 minutes. During this procedure the melt entered the mold, infiltrated the fibers and immediately solidified in the mold above the level of the melt. The tube was immediately removed from the melt and allowed to cool. After removing the flux and alloy on the outer surface, the steel tube was machined off and the remaining composite was centerless ground to a 0.139 ± .001 inch diameter rod 4 inches in length.

Mechanical properties of the ground rods at room temperature are given under item (a) in Table I. Values obtained at 600° F. and 900° F. follow: flexural strengths of $134 \times 10^3$ and $105 \times 10^3$ psi; moduli (Mi) of $38 \times 10^6$ and $33 \times 10^6$ psi and short beam shears (S.B.S) of $14 \times 10^3$ and $6.9 \times 10^3$ psi, respectively.

Metallographic examination of polished cross-sections of the composite revealed none or very little of a second phase in the matrix. It may be that a "super saturated" solid solution of lithium in the aluminum matrix was produced.

Samples of the composites were treated with aqueous HCl, the fibers recovered from the acidic solution of the matrix and the solution analyzed for lithium. The analysis showed 1.9% lithium in the matrix against 3.9% in the melt used. It is believed that a considerable amount of the original lithium in the melt is in an acid-insoluble form in the reaction sheath. The recovered fibers were black instead of the original white color, indicating a reaction with the lithium, and retained 83% or more of their original tensile strength.

EXAMPLE 2

The items of this example show the effect of lithium content and infiltration temperature and time on composites of Al-Li/polycrystalline alumina fibers.

Following the general procedure of Example 1, composites were made with various Al—Li alloys using yarns containing silica coated filaments (B) similar to those of Example 1 and yarns of uncoated filaments (A). Yarns of items (a), (b), (f), (g), (k) and (q) in TABLE I contained 95 continuous filaments and the remainder contained 210 continuous filaments of polycrystalline alumina containing about 99.8% $Al_2O_3$, predominantly in the alpha form, each having a diameter of about 23± 4 μ. Fiber codes in Table I indicate nominal tensile strengths of the starting filaments as follows:

A: 180,000 to 200,000 psi
B: 200,000 to 239,000 psi
B-2: 240,000 to 260,000 psi

At equal fiber loadings, the maximum possible flexural strength of the composites is directly related to the strength and density of the original fibers. All of the fibers had a modulus of about $50 \times 10^6$ psi. Three of the composites, items (n), (o) and (p) were made with a matrix of a ternary alloy. Item (n) was a ternary alloy of aluminum (95.7%), lithium (2%) and magnesium (2.3%); item (o) was a ternary alloy of aluminum (91.5%), lithium (2.2%) and zinc (6.3%); item p was a ternary alloy of aluminum (91%), lithium (4.6%) and silicon (4.4%). All composites contained about 50 volume percent of fibers except items (a) (Example 1) and (b) which contained about 60 volume percent and item (f) which contained about 55 volume percent. After infiltration, all composites were removed from the metal bath within 3 minutes except item (c) which was held in the bath for 15 minutes and item (h) which was held in the bath for 5 minutes.

Items (a), (b), (d), (e), (f), (g), (h), (k), (n), (o) and (q) represent preferred products of the invention. The extent of fiber reaction was minimal and the thickness of the fiber reaction sheath was less than about 2% of the total fiber diameter.

A useful but less preferred group of composites included items (i), (j) and (l) with a maximum fiber reaction sheath thickness of 3 μ (about 13% of total fiber diameter).

Items (c) and (m) were comparative examples of composites beyond this invention with fiber reaction sheath thicknesses of from 4–8 μ (17–33% of the reacted fiber diameter of about 24 μ). A comparison of the flexural properties of items (c) and (d) shows the adverse effect of a thick reaction sheath caused by too long an exposure time at 700° C. Item (m) had a porosity of greater than 10% on the average and showed the adverse effect of a higher than normal infiltration temperature (900° C.).

Two other composites (g) and (r) were made similarly to item (k) from alumina fibers C and D, respectively, (about 50 volume percent) and Al—Li alloys containing about 4.8–5.5% lithium. Fiber C was a polycrystalline alumina fiber (diameter about 23 μ) made in a manner similar to Example 8 of U.S. Pat. No. 3,808,015 to Seufert except that the solid particles in the spin mix (which provide 60% of the final $Al_2O_3$ in the fiber) consisted of 77% of alpha-alumina particles (50% with an equivalent diameter between 0.2 and 5 μ) and 23% of gamma-alumina particles having a diameter of 0.005 μ to 0.07 μ. Fiber D (diameter about 23 μ) was made as was fiber C except that the gamma-alumina particles constituted about 40% of the solid particles of the spin mix. Fibers C and D were used in the form of yarns containing 95 continuous filaments.

The silica coated filaments of this example contain about 0.19 to 1.9% $SiO_2$ which is equivalent to a silica coating thickness of from about 0.02 to 0.2 μ for a 23 μ diameter starting filament.

TABLE I

| ITEM | % Li MELT | % Li MATRIX | MELTING POINT OF ALLOY ° C. | FIBER | INFILTRATION TEMP. ° C. | FIBER REACTION SHEATH, μ | COMPOSITE %POROSITY | FLEXURAL STRENGTH Psi × $10^{-3}$ | % STRAIN AT FAILURE | S.B.S. psi × $10^{-3}$ | MODULUS (Mi) psi × $10^{-6}$ |
|---|---|---|---|---|---|---|---|---|---|---|---|
| a | 3.9 | 1.9 | 637 | B | 680–700 | <0.5 | <2 | 127 | 0.32 | 14 | 39 |
| b | 2 est. | 0.7 | 647 | B | 700 | <0.5 | <2 | 146 | 0.36 | 11 | 43 |
| c | 5.9 | 1.9 | 625 | A | 700 | 4 | 5–10 | 50 | 0.19 | 6 | 27 |
| d | 5.9 | 4.2 | 625 | A | 700 | <0.5 | 5–10 | 102 | 0.33 | 12 | 31 |
| e | 5.0 | 2.6 | 630 | A | 700 | <0.5 | <2 | 136 | 0.39 | 16 | 36 |
| f | 1.8 | 1.5 | 648 | B-2 | 700 | <0.5 | <2 | 134 | 0.40 | 13 | 35 |
| g | 2.5 | 2.0 | 645 | B-2 | 700 | <0.5 | <2 | 144 | 0.41 | 16 | 36 |
| h | 2.4 | 1.8 | 646 | A | 700 | <0.5 | | 135 | 0.41 | 14 | 35 |
| i | 2.5 | 1.9 | 645 | B | 750 | 1.5 | 2–5 | | | | |
| j | 5.0 | 2.9 | 630 | B-2 | 700 | 2.0 | <2 | 89 | 0.29 | 12 | 32 |
| k | 4.8–5.5 | 3.7 | 627–632 | B-2 | 700 | <0.5 | <2 | 113 | 0.35 | 113 | 33 |
| l | 7.8 | 4.3–5.4 | 613 | B | 700 | 3.0 | 2–5 | | | | |
| m | 2 | 0.8 | 647 | B | 900 | 6–8 | 8–15 | | | | |
| n | 2.0(1) | 1.7(2) | 650 | B-2 | 700 | <0.5 | <2 | 96 | 0.34 | 11 | 29 |
| o | 2.2(3) | 2.0(4) (estimated) | 628 | B | 700 | <0.5 | ~2 | 93 | 0.31 | 11 | 32 |
| p | 4.6(5) | 1.5(6) | 630 | B-2 | 700 | <0.5 | ~2 | 106 | 0.33 | 12 | 33 |
| q | 4.8–5.5 | 3.4 | 627–632 | C | 700 | <0.5 | <2 | 110 | 0.38 | 12 | 30 |
| r | 4.8–5.5 | 2.2 | 627–632 | D | 730–740 | 3.0 | <2 | 76 | 0.32 | 8 | 25 |

(1)plus 2.3% Mg
(2)plus 1.8% Mg
(3)plus 6.3% Zn
(4)plus 6.3% Zn
(5)plus 4.4% Si
(6)plus 2.0% Si

EXAMPLE 3

Using the preform technique of Example 1 of U.S. Pat. No. 3,828,839 to Dhingra, a yarn of 95 continuous filaments of polycrystalline alumina containing about 99.8% $Al_2O_3$, predominantly (greater than 90%) in the alpha form, (nominal tensile strength of 150,000 to 179,000 psi; tensile modulus 50 × $10^6$) with a diameter of about 23 μ was made into a tape by winding the yarn on a mandrel, coating the yarn layer with a 5% solution of poly(ethylacrylate) in methyl ethyl ketone, drying in air for about 5 minutes and repeating the winding and coating. The tape was removed from the mandrel, cut to size and compressed to fit a sectional rectangular mold. The mold of stainless steel had inside dimensions of 5 × 3.5 × 0.5 inches with a tube attached to one 3.5 inch edge and the other 3.5 inch edge open. The poly(ethylacrylate) was removed by heating the loaded mold at 600° C for 4 hours while drawing air through it. The fibers in the mold were rinsed with acetone, dried and then vibrated.

The fibers in the mold were infiltrated at 710° C. for about 5 minutes with an Al—Li alloy containing 4.9% Li and having a melting point of about 630° C. The mold was removed by machining and the composite containing 45 volume percent of fibers was divided into two 3/16inch thick pieces which were finish ground to 1/8 inch thicknesses. The composite contained 2.2% lithium in the matrix, a fiber reaction sheath having a thickness of 2.5 μ (about 11% of the total fiber diameter) and had a porosity of <2%. Average, transverse strength and modulus properties of specimens cut from the above pieces follow:

| Test Temperature | Strength psi × $10^{-3}$ | Modulus psi × $10^{-6}$ |
|---|---|---|
| ca. 70° F. | 25 | 14 |
| 600° F. | 27 | 13 |

It was unexpected that the composites would retain these transverse properties at 600° F. since other metal/fiber composite systems such as Al/B, Mg/$Al_2O_3$ and Al/C show a significant loss in properties at 600° F.

Other test specimens taken from the same composite had a following average room temperature longitudinal flexural properties: strength 79 × $10^3$ psi, modulus 26 × $10^6$ psi and S.B.S. 11 × $10^3$ psi. The lower strength compared to Example 1 is due to the fiber loading (about 45 volume percent), the use of a weaker starting fiber and the greater extent of fiber reaction.

EXAMPLE 4

A mixture of 30% alpha-alumina particles, 41.3% solid aluminum chlorohydroxide [$Al_2(OH)_5Cl.2.2H_2O$], 0.6% $MgCl_2.6H_2O$, 2.2% concentrated hydrochloric acid and 25.8% water was made and concentrated by removal of water to give a spin dope with a viscosity of about 800 poises at 30° C. The spin dope was extruded from a spinneret into a heated spinning column and the precursor fibers are forwarded by 2 feed rolls at about 900 feet/minute and wound up on a collapsible, refractory bobbin. The bobbins were stored in a room at 10% relative humidity until fired. The bobbins were placed in a cold oven which is then heated to 550° C. in about 2 hours, held at 550° C. for 45 minutes and cooled. The yarn was then passed at 60 feet/minute vertically downward through a chimney with a ring burner with propane-oxygen flames and fired at an apparent yarn temperature of about 1555° C. measured with an optical pyrometer with no correction for emissivity. This temperature was above the temperature at which the fiber develops maximum strength. The yarn is designated as (F) below.

A second yarn (E below) was prepared in the same manner from an equivalent spin mix except that it was spun on a different day and in a slightly different chimney with the propane-oxygen ratio adjusted to develop about the maximum tensile strength of the fibers. It is estimated that these firing conditions in the firing unit used for yarn F would have caused an apparent yarn temperature of about 1500°–1530° C. A comparison of the two yarns follows:

| | Yarn E | Yarn F |
|---|---|---|
| Denier | 2040 | 1790 |
| Number of continuous filaments | 196 | 198 |
| Average Fiber diameter, μ | 20.0 | 18.2 |
| Average Tensile strength, psi | 249,000 | 196,000 |
| Translucency number | 4.3 | 5.1 |
| Density from scanning electron microscope view of fractured cross sections | | Denser than E |

Both yarns were then treated to give them a 0.02 to 0.05μ thick coating of silica on the fibers.

A lithium-aluminum alloy was made using the procedure of Example 1 with pure lithium (99.98%). Composites (s) and (t) were made from yarns E and F, respectively, using the procedure described in Example 1. Details and results of the product characterizations are given in the Table II. Both composites contained 60 volume percent of fibers.

The fibers (black) recovered from the composites after dissolution of the matrix in about 18% hydrochloric acid had tensile strengths of 70 and 100% of the original fibers for items (s) and (t), respectively. Thus the more dense starting fiber of item (t) gave a stronger composite than items (s) even though the starting fiber for (t) had a lower initial tensile strength.

having an average thickness of 1 μ and had a porosity of about 5%.

Average room temperature tensile strength and modulus flexural properties of the test coupons were 17,400 psi and 12.5 × $10^6$ psi, respectively. For random fiber orientation in a plane, the strength of the composite is given by -

$$\sigma_C = \sigma_M(1 - V_{F-V_P}) + \tfrac{1}{3}\,\sigma_F V_F$$

where:

$\sigma_C$ = composite strength $\sigma_M$ = flow stress of aluminum matrix at the fiber fracture strain $V_F$ = fiber volume fraction $V_P$ = volume fraction of porosity $\sigma_F$ = fiber strength The flow stress ($\sigma_M$) of a comparable as-cast Al- 4 wt %Li was 6,200 psi. The calculated composite strength was:

$$19{,}250 = 6{,}200\,(1 - 0.20 - 0.05) + \tfrac{1}{3}\,(219{,}000)\,0.20$$

Hence, over 90% of the rule of mixtures was observed. The observed modulus performance represents approximately 23% stiffness improvement over the unreinforced alloy (10.2 × $10^6$ psi).

TABLE II

| ITEM | % Li MELT | % Li MATRIX | MELTING POINT OF ALLOY ° C. | FIBER | INFILTRATION TEMP. ° C. | FIBER REACTION SHEATH, μ | COMPOSITE % POROSITY | FLEXURAL STRENGTH psi × $10^{-3}$ | % STRAIN AT FAILURE | S.B.S. psi × $10^{-3}$ | MODULUS (Mi) psi × $10^{-6}$ |
|---|---|---|---|---|---|---|---|---|---|---|---|
| s | 3.1 | 2.7 | 640° C. | E | 700° C. | <.5μ | <2% | 106.5 | 0.31 | 12.3 | 34.7 |
| t | 3.1 | 3.0 | 640° C. | F | 700° C. | <.5μ | <2% | 133 | 0.34 | 17.3 | 39.8 |

For comparative purposes, the translucency numbers for fibers used to make items (a), (b), (c), (d), (g) and (j) in Table I were 5.1, 5.1, 2.2, 2.2, 5.0 and 2.7, respectively.

EXAMPLE 5

A yarn containing 210 continuous filaments (average diameter of 23μ) of silica-coated, polycrystalline alumina (tensile strength 219,000 ± 19,000 psi), 99% $Al_2O_3$, predominantly (greater than 90%) in the alpha form, was cut into about 0.125 inch lengths and dropped into a stainless steel mold (5.75 × 2.75 × 0.50 inches) with one narrow side (0.50 × 2.75 inches) sealed except where it was welded in the middle to a 0.25inches OD tube while the opposite narrow side was open. After the addition of each 0.25 inch layer of fiber, the fiber was gently packed using a 7/16 inch solid rod. The gentle packing resulted in a randomly oriented loading of the fibers substantially in one plane (the plane parallel to the 0.5 inch × 2.75 inches sides of the mold). The final loading of the fiber was 20 volume percent and sufficiently tight so that the fibers did not fall when the mold was inverted for infiltration.

The fibers in the mold were infiltrated at 680°-700° C. with an aluminum alloy containing about 4.0% lithium (melting point about 640° C.). The mold was machined off and test coupons were sliced from the composite plate in planes parallel to the 0.5 × 2.75 inches sides. The final composite test coupon dimensions after finish grinding were 0.125 × 0.450 × 2.70 inches with the plane containing the randomly oriented fibers parallel to the 0.450 × 2.70 inches sides. The composite contained 3.7% lithium in the matrix, a fiber reaction sheath Other test specimens taken from the same composite had the following average room temperature flexural strength properties: strength 41 × $10^3$ psi and S.B.S. 5.4 × $10^3$ psi. The lower stength compared to Example 1 was due to the lower volume loading (20 volume percent) and random orientation of the fiber.

Other test specimens taken from the same composite had the following average flexural properties measured at 600° F.: strength 46 × $10^3$ psi, modulus 8.4 × $10^6$ psi and S.B.S. 6 × $10^3$ psi.

It should be noted that high quality Al—Li alloys cannot be practically fabricated in the same manner in which most conventional aluminum alloys are prepared since lithium metal has a much lower density, a much lower melting point, a higher vapor pressure than aluminum and oxidizes even at room temperature. Accordingly, it is recommended that the aluminum is melted initially and that the lithium is submerged in the molten aluminum pool. Such a procedure reduces lithium losses due to sublimation. Quality alloys (i.e., free of oxide inclusions) can be prepared under an inert atmosphere such as argon (nitrogen atmospheres are not preferred since lithium nitride is formed at room temperature) or by the use of a suitable protective layer of flux on the molten metal surface. The use of a flux such as, for example, LiCl:LiF in a 3 to 1 ratio by weight, is preferred since it is an economical method to prevent oxidation and sublimation of the lithium. An additional practical advantage of the fluxing technique over the use of an inert atmosphere is that the alloys can be prepared using more practical foundry techniques such as skimming away dross formation on the surface of the melt and replenishing the flux layer as required. After a high quality Al—Li alloy is prepared and allowed to cool to room temperature, a high quality melt can be obtained by reheating the alloy with a protective layer of the flux.

It is to be understood that the foregoing is solely for the purposes of illustration and that, although the invention has been described in considerable detail herein, variations may be made by those skilled in the art without departing from the spirit and scope of the invention.

What is claimed is:

1. A process comprising the steps of placing polycrystalline alumina fibers in a mold, forming a composite reinforced with 10–80 volume percent of said fibers and having a porosity of less than about 10% by infiltrating the fibers in the mold with a molten aluminum alloy containing about 1–8% by weight of lithium for a time sufficient to form a reaction sheath on the fibers which has a thickness of less than 15% of the total fiber diameter and cooling the composite.

2. The process of claim 1 wherein the infiltration temperature is 25°–100° C. above the melting point of the aluminum alloy and the time is less than about 15 minutes.

3. The process of claim 1 wherein the aluminum-lithium alloy contains at least about 60% by weight of aluminum.

4. The process of claim 3 wherein the aluminum alloy contains at least about 90% by weight of aluminum.

5. The process of claim 3 wherein the aluminum-lithium alloy contains 2–5% by weight of lithium.

6. The process of claim 3 wherein the aluminum-lithium alloy contains up to about 10% by weight of one or more metals capable of being alloyed with aluminum.

7. The process of claim 1 wherein the alumina fibers are coated with a 0.01–1 micron thick coating of silica.

8. The process of claim 1 wherein the polycrystalline alumina fibers have a translucency number of 4–5.5.

9. The process of claim 1 wherein the polycrystalline alumina fibers have a diameter of 15–30 $\mu$, a tensile strength of at least 100,000 psi and a Young's modulus of at least 20 million psi.

10. The process of claim 1 in which a layer of flux is positioned on the surface of the alloy.

11. The process of claim 10 in which the flux is a 3:1 weight ratio of LiCl:LiF.

* * * * *